US006354731B1

(12) United States Patent
Halter

(10) Patent No.: US 6,354,731 B1
(45) Date of Patent: Mar. 12, 2002

(54) OSCILLATING WINDING WEIGHT FOR A TIMEPIECE WITH AN AUTOMATIC MOVEMENT AND TIMEPIECE FITTED WITH SUCH A WINDING WEIGHT

(75) Inventor: Vianney Halter, Sainte-Croix (CH)

(73) Assignee: Janvier S.A., Sainte-Croix (CH)

( * ) Notice: Subject to any disclaimer, the term of this patent is extended or adjusted under 35 U.S.C. 154(b) by 0 days.

(21) Appl. No.: 09/462,359

(22) PCT Filed: Apr. 30, 1999

(86) PCT No.: PCT/EP99/02986

§ 371 Date: Jan. 7, 2000

§ 102(e) Date: Jan. 7, 2000

(87) PCT Pub. No.: WO99/57613

PCT Pub. Date: Nov. 11, 1999

(30) Foreign Application Priority Data

May 7, 1998 (EP) ..... 98108338

(51) Int. Cl.[7] ..... G04B 5/18

(52) U.S. Cl. ..... 368/148; 368/150; 368/168; 368/169; 368/206

(58) Field of Search ..... 368/206, 148, 368/150, 169, 151, 223, 168, 208

(56) References Cited

U.S. PATENT DOCUMENTS 2,936,571 A * 5/1960 Biemiller ..... 368/168
3,893,290 A * 7/1975 Fluck et al. ..... 368/206
3,942,317 A * 3/1976 Schluep ..... 368/169
4,057,885 A * 11/1977 Giger et al. ..... 368/168
4,534,660 A * 8/1985 Laesser ..... 368/223
4,926,401 A * 5/1990 Vuilleumier et al. ..... 368/223
5,119,348 A * 6/1992 Mathys ..... 368/151
6,021,098 A1 * 2/2001 Rebeaud ..... 368/208

FOREIGN PATENT DOCUMENTS

EP 360 140 3/1990

OTHER PUBLICATIONS

JP 360250282, Higashiya et al., Time Piece, abstract, Dec. 1985.*

DE003513961, Assmus et al., Device for detecting the state of the motion in an electronic clock, in particular a radio–controlled clock, abstract, Oct. 1986.*

Erstarrte Fronten durchbrechen, vol. 38, No. 23, Dec. 1983, p. 22.

* cited by examiner

*Primary Examiner*—Christopher W. Fulton
*Assistant Examiner*—Jeanne-Marguerite Goodwin
(74) *Attorney, Agent, or Firm*—Sughrue, Mion, Zinn, Macpeak & Seas, PLLC

(57) ABSTRACT

The invention concerns an oscillating winding weight for a timepiece including a heavy portion secured to a connecting element connecting said heavy portion to an arbour fixed to the movement, said weight being intended to be rotatably mounted on said arbour, characterised in that said connecting element is made of a transparent or translucent material.

10 Claims, 4 Drawing Sheets

OSCILLATING WINDING WEIGHT FOR A TIMEPIECE WITH AN AUTOMATIC MOVEMENT AND TIMEPIECE FITTED WITH SUCH A WINDING WEIGHT

BACKGROUND OF THE INVENTION

The present invention concerns an oscillating winding weight for a timepiece with an automatic movement. More particularly, the invention concerns a winding weight of this type intended to be fitted to a wristwatch including a transparent back cover, said weight being arranged on the side of the back cover of the case and allowing permanent observation of the whole of the movement.

Wristwatches having cases with transparent back covers to allow observation of their movement are already known. However, when these watches include a movement with automatic winding mechanism, observation of the movement is always curtailed by the presence of the oscillating winding weight which, even when pierced, as is the case in so-called <<skeleton>> watches, prevents comfortable observation of the movement.

SUMMARY OF THE INVENTION

The main object of the present invention is thus to overcome the drawbacks of the aforementioned prior art, by providing an oscillating winding weight allowing observation of the movement to which it is fitted without any visible obstacle.

The invention thus concerns an oscillating winding weight for a timepiece including a heavy portion fixed to a connecting element connecting said heavy portion to an arbour fixed to a movement, said weight being intended to be rotatably mounted on said arbour, characterised in that said connecting element is made of a transparent or translucent material.

As a result of this new winding weight structure, it is possible to make the whole of the movement of the timepiece to which it is fitted permanently visible, which gives the timepiece an improved aesthetic appearance.

According to a preferred embodiment of the invention, the connecting element is formed of a full sapphire disc.

It will be noted in particular in this respect that the use of sapphire in a winding weight as a connecting element between the heavy portion and the movement goes against the preconceived ideas of those skilled in the art who, when having to design winding weights, always tend to use materials having a high strength, i.e. a good capacity to absorb the shocks to which the weight is subjected during its rotation.

According to another aspect, the invention also concerns a timepiece including a case formed of a middle part closed by a crystal and an at least partially transparent back cover and in which clockwork movement with an automatic winding mechanism is housed, characterised in that said movement is fitted with an oscillating winding weight as defined hereinbefore.

BRIEF DESCRIPTION OF THE DRAWINGS

Other features and advantages of the present invention will appear in the following description of a preferred embodiment, given by way of non limiting example with reference to the annexed drawings, in which.

DETAILED DESCRIPTION OF THE INVENTION

Figure 1:
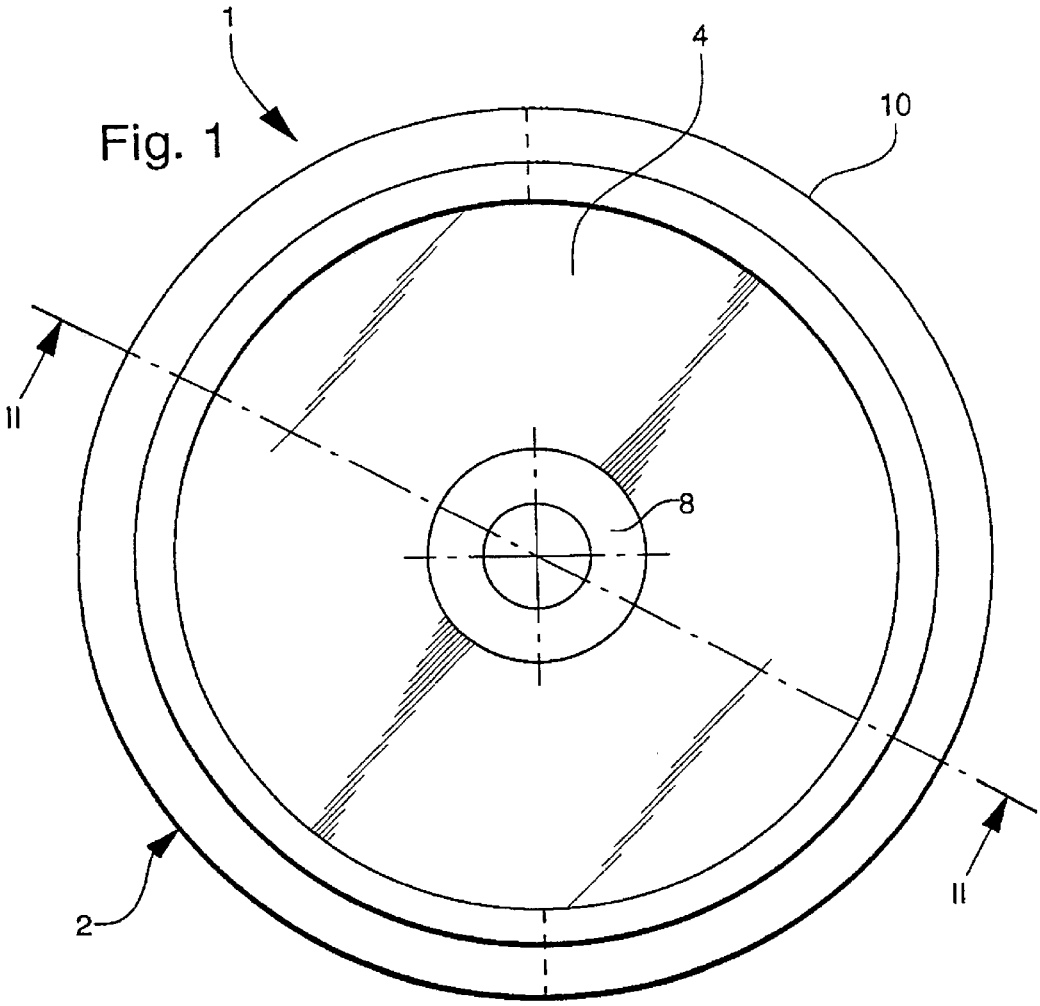
FIG. 1 is a plan view of a first embodiment of an oscillating winding weight according to the invention.
Figure 2:
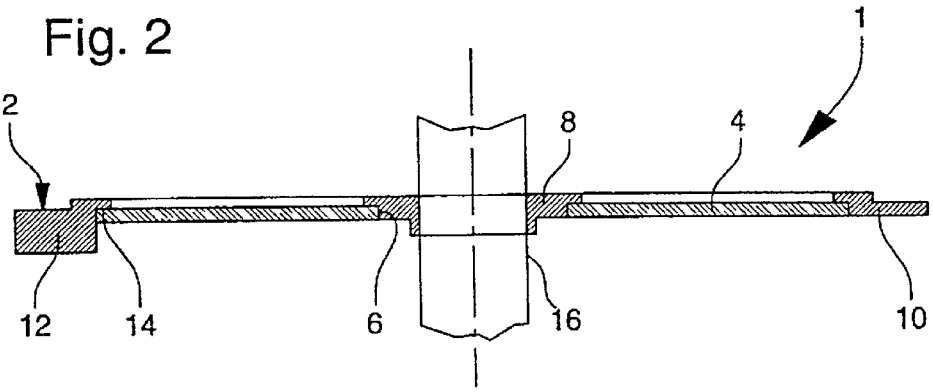
FIG. 2 is a cross-section along the line II—II of FIG. 1.
Figure 8:
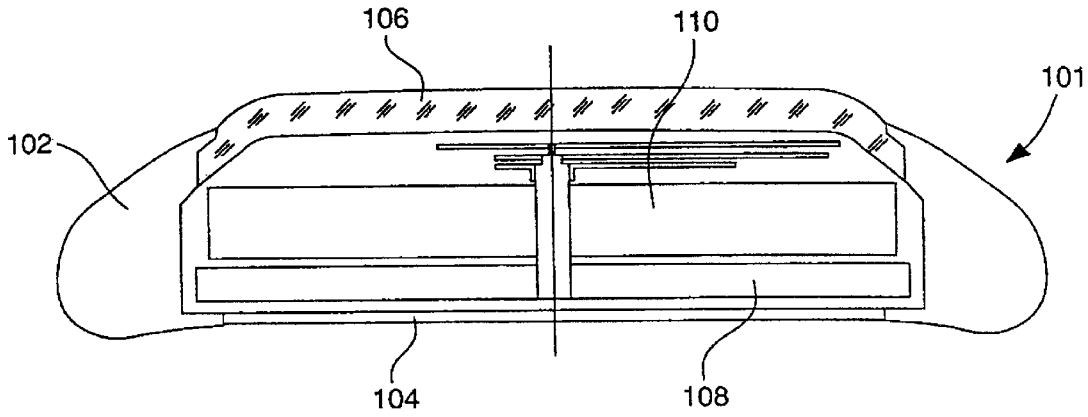
FIG. 8 is a sectional view of a timepiece embodying the weight of FIG. 1.

FIGS. 1 and 2 show a first embodiment of an oscillating winding weight according to the invention, designated by the general reference 1. As shown in FIG. 8, this weight 108 is intended to be fitted in a conventional manner to the automatic or self winding movement 110 of a timepiece 101 including a case formed of a middle part 102 closed by a crystal 106 and an at least partially transparent back cover 104 to make the movement 110 visible from the back cover 104.

Winding weight 1 includes a heavy portion 2 fixed to a connecting element 4 connecting the heavy portion to an arbour 16 fixed with a clockwork movement, weight 1 being intended to be rotatably mounted on said arbour. For this purpose, the connecting element includes at its centre an opening 6 into which a ring 8, forming the hub of weight 1 is driven.

According to the invention, connecting element 4 is formed of a full disc made of a transparent material such as sapphire which allows the movement to be observed through weight 1. It goes without saying that any other transparent or translucent, synthetic or natural material can be used. In all cases, the material will have at least to allow light to pass through to be able to distinguish the shapes of the elements situated behind it.

Heavy portion 2 includes a ring 10 which includes on an arc of a circle of approximately 180° an unbalance 12 which is formed by an overthickness of said ring 10. In the example illustrated, ring 10 and unbalance 12 are made in a single part. Preferably, heavy portion 2 is made of a high density metal, for example, a tungsten alloy. However, it goes without saying that according to a variant, unbalance 12 can be secured to ring 10 by any conventional securing means such as screwing, bonding, crimping, soldering or suchlike. In this case, ring 10 can be made of a material which is easy to machine, such as steel, and unbalance 12 of a tungsten alloy. In the example shown, ring 10 includes a rabbet 14 in which disc 4 is engaged and bonded. However, it goes without saying that according to a variant, this disc 4 can be fixed in rabbet 14 by any other conventional securing means such as screwing, riveting or suchlike.

Figure 3:
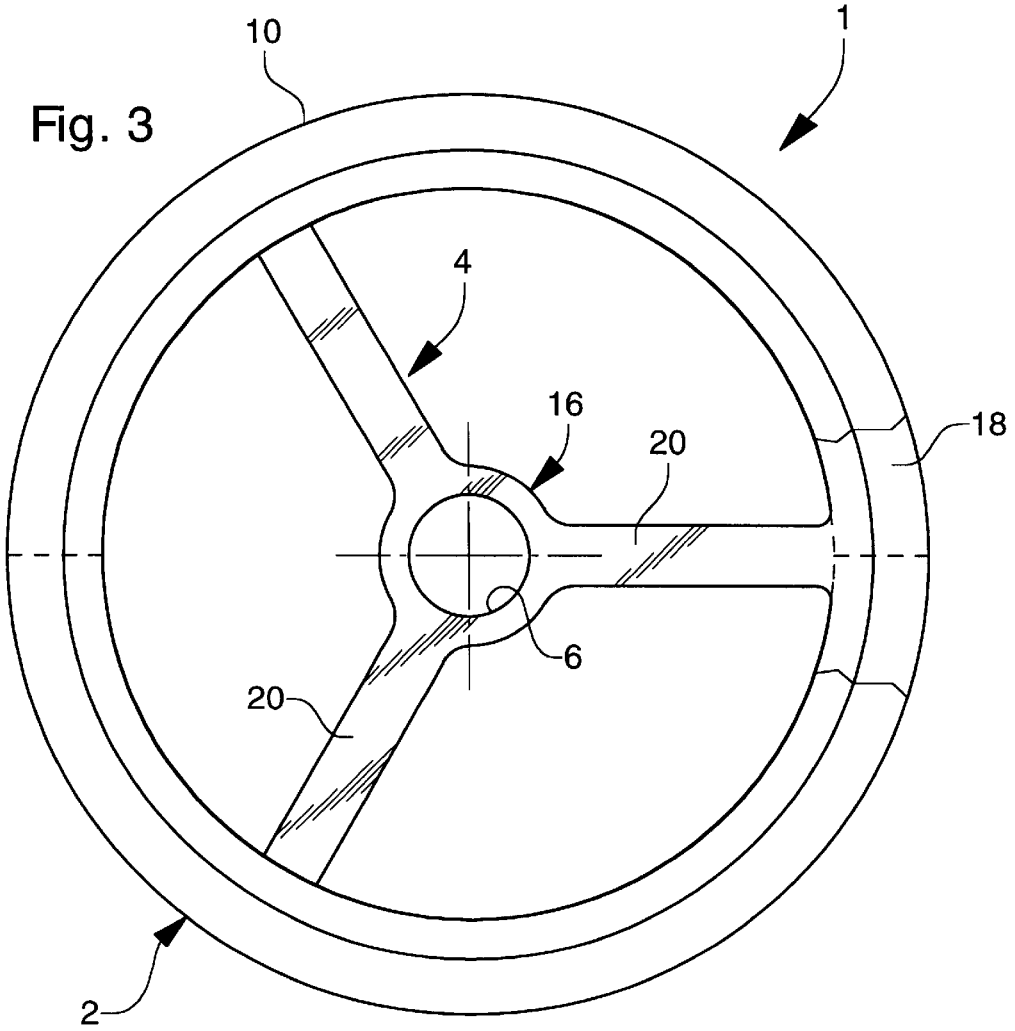
FIG. 3 is a plan view of a second embodiment of an oscillating winding weight according to the invention.

FIG. 3 shows a second embodiment of an oscillating winding weight according to the invention. In this Figure and the following Figures, the elements which are identical to those described in connection with FIGS. 1 and 2 have been designated by the same numerical references. It will also be noted that, for the purposes of clarity, ring 8 forming the hub of weight 1 has been omitted from FIG. 3.

Unlike the embodiment shown in FIGS. 1 and 2, connecting element 4 of this embodiment is formed of a partially hollowed disc which is also made of sapphire. More precisely, connecting element 4 includes a central portion 16 provided with opening 6 and a peripheral ring 18 concentric with opening 6, central portion 16 being connected to peripheral ring 18 by three arms 20. The recesses of disc 4 will advantageously be made using diamond wheels or using a laser beam.

Figure 4:
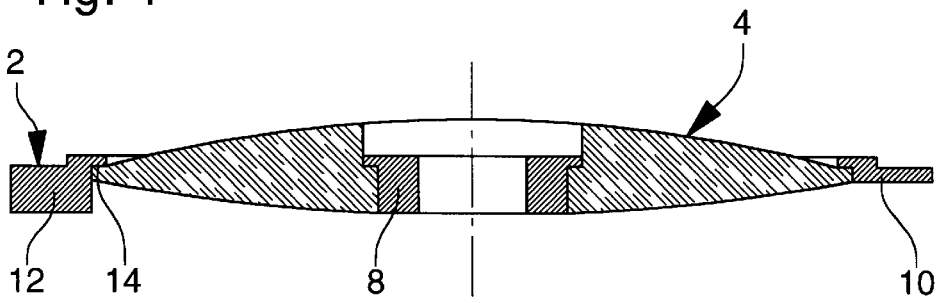
FIG. 4 is a cross-section, similar to that shown in FIG. 2, of a third embodiment according to the invention.

FIG. 4 shows a third embodiment of an oscillating winding weight 1 according to the invention wherein connecting element 4 is formed of a circular optical magnifying lens. It goes without saying that according to alternative embodiments, any other type of optical lens can be envisaged. One could in particular provide Fresnel lenses which have the peculiarity of being flatter than a conventional lens for a given magnification. One could also envisage using lenses producing kaleidoscopic effects for connecting elements 4.

Figure 5:
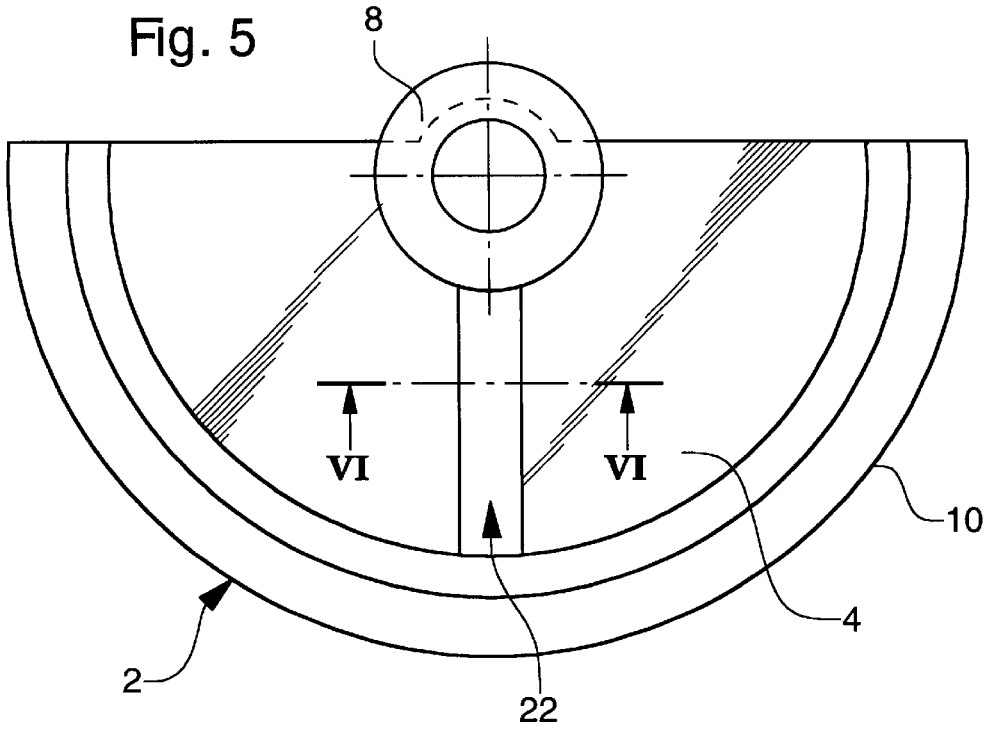
FIG. 5 is a plan view of a fourth embodiment of an oscillating winding weight according to the invention.
Figure 6:
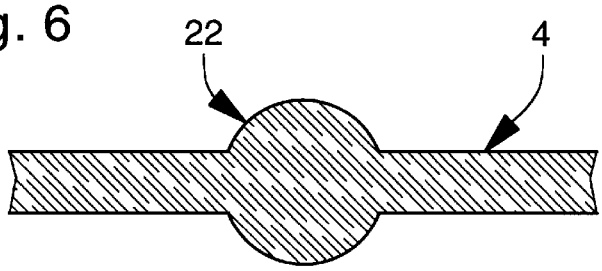
FIG. 6 is a partial cross-section along the line VI—VI of FIG. 5.

FIGS. 5 and 6 show a fourth embodiment of an oscillating winding weight according to the invention wherein connecting element 4 is formed of a transparent plate in the shape of an angular sector extending over approximately 180° and wherein heavy portion 2 is formed by a ring portion extending to the periphery of plate 4 over an arc of a circle of approximately 180°. Plate 4 is made of sapphire and further includes an optical magnifying glass 22 which extends radially from ring 8 to the ring of heavy portion 2.

Figure 7:
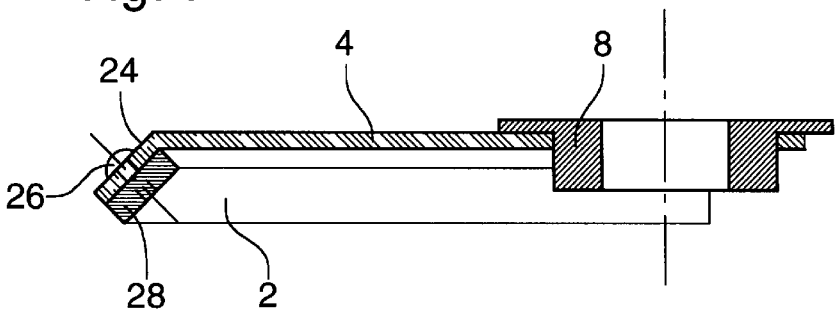
FIG. 7 is a cross-section of a fifth embodiment according to the invention.

FIG. 7 shows a fifth embodiment of an oscillating winding weight 1 according to the invention wherein connecting element 4 is formed of a transparent plate in the shape of an angular sector extending over approximately 180° and including at its periphery an edge 24 bent in a slant. In this embodiment heavy portion 2 is also formed by a ring portion extending over an arc of a circle of approximately 180° and fixed by means of screws 26 onto the inner face 28 of edge 24. It will be noted that, as a result of bent edge 24, this embodiment of oscillating weight 1 allows it be better fitted to the outer shape of the movement to which it is intended to be fitted, it being understood that edge 24 is bent in the direction of the movement.

What is claimed is:

1. Oscillating winding weight for a timepiece including a heavy portion secured to a connecting element connecting said heavy portion to an arbour fixed to a movement of the timepiece, said weight being intended to be rotatably mounted on said arbour, characterised in that said connecting element is made of a transparent or translucent material.

2. Winding weight according to claim 1, characterised in that said connecting element is formed of a full disc.

3. Winding weight according to claim 2, characterised in that said connecting element is made of sapphire.

4. Winding weight according to claim 3, characterised in that said heavy portion is formed of a ring portion extending over an arc of a circle of approximately 180°.

5. Winding weight according to claim 3, characterised in that said heavy portion is formed of a circular ring including, over an arc of a circle of approximately 180°, an unbalance.

6. Winding weight according to claims 3, characterised in that said heavy portion is secured to said connecting element by bonding.

7. Winding weight according to claim 1, characterised in that said connecting element is formed of an at least partially hollowed disc.

8. Winding weight according to claim 1, characterised in that said connecting element is formed of at least two connecting arms.

9. Winding weight according to claim 1, characterised in that said connecting element includes an optical lens.

10. Timepiece including a case formed of a middle part closed by a crystal, an at least partially transparent back cover, and a self winding clockwork movement housed in said case, characterised in that said movement is fitted with an oscillating winding weight including a heavy portion secured to a connecting element connecting said heavy portion to an arbour fixed to said movement, said weight being intended to be rotatably mounted on said arbour, said collecting element being made of a transparent or translucent material.

* * * * *